US012767395B2

(12) United States Patent
Hsieh et al.

(10) Patent No.: US 12,767,395 B2
(45) Date of Patent: Oct. 20, 2026

(54) CONTAINER ASSEMBLY AND CONTAINER LID

(71) Applicant: TIMAS TITAN CO., LTD., Taipei City (TW)

(72) Inventors: Han-Chun Hsieh, Taipei City (TW); Han-Chieh Hsieh, Taipei City (TW)

(73) Assignee: TIMAS TITAN CO., LTD., Taipei City (TW)

( * ) Notice: Subject to any disclaimer, the term of this patent is extended or adjusted under 35 U.S.C. 154(b) by 0 days.

(21) Appl. No.: 19/299,359

(22) Filed: Aug. 14, 2025

(65) Prior Publication Data

US 2025/0368400 A1 Dec. 4, 2025

Related U.S. Application Data

(63) Continuation-in-part of application No. 18/319,496, filed on May 18, 2023, now abandoned, which is a (Continued)

(30) Foreign Application Priority Data

May 7, 2021 (TW) ..... TW110116481

(51) Int. Cl.
*B65D 43/02* (2006.01)
*B65D 81/38* (2006.01)
(Continued)

(52) U.S. Cl.
CPC ..... *B65D 43/0229* (2013.01); *B65D 81/3841* (2013.01)

(58) Field of Classification Search
CPC ..... A45C 11/008; A45C 11/20; A45C 7/005; A45D 2040/0006; A45D 2200/052; (Continued)

(56) References Cited

U.S. PATENT DOCUMENTS 3,476,277 A * 11/1969 Rownd ..... A47J 41/02 D7/608
6,237,787 B1 * 5/2001 Gallo ..... B65D 81/365 222/105
2002/0008113 A1 * 1/2002 Fujii ..... B65D 81/3818 220/592.2

FOREIGN PATENT DOCUMENTS

DE 3506779 C2 * 8/1987 ..... A47J 41/0044
DE 3904885 A * 2/1989 ..... A47G 23/04
(Continued)

*Primary Examiner* — Anthony D Stashick
*Assistant Examiner* — Marcos Javier Rodriguez Molina
(74) *Attorney, Agent, or Firm* — Li & Cai Intellectual Property Office

(57) ABSTRACT

A container assembly and a container lid are provided. The container assembly includes a container body, and a lid, a sleeved portion, an annular pressing portion, and a straw. The container body has an opening portion at an upper end thereof. The lid is detachably disposed on the opening portion. The lid has an outer lid portion, an inner lid portion, and a connection portion, and the outer lid portion, the inner lid portion, and the connection portion jointly define a first heat insulation space. The connection portion has an annular abutting section, an enclosed end section, and an outer thread section arranged between the annular abutting section and the enclosed end section, and a distance between the enclosed end section and the annular abutting section is less than a distance between the enclosed end section and an inner lid top board of the inner lid portion.

19 Claims, 14 Drawing Sheets

Related U.S. Application Data continuation-in-part of application No. 17/540,165, filed on Dec. 1, 2021, now abandoned.

(51) Int. Cl.
*A47G 19/22* (2006.01)
*B65D 51/28* (2006.01)
*B65D 53/02* (2006.01)

(58) Field of Classification Search
CPC ..... A45D 2200/152; A45D 40/00; A45F 3/18; A45F 5/1566; A47G 19/00; A47G 19/127; A47G 19/2288; A47G 23/04; A47J 2203/00; A47J 27/12; A47J 36/027; A47J 39/006; A47J 41/00; A47J 41/0011; A47J 41/0044; A47J 41/0072; A47J 41/0077; A47J 41/0094; A47J 41/02; A47J 41/022; A47J 41/028; A47J 47/06; A61G 17/08; A63H 3/005; B01J 20/18; B01J 20/20; B05B 11/0005; B23K 20/023; B29C 65/02; B29C 65/06; B29C 65/0672; B29C 66/001; B29C 66/0242; B29C 66/12441; B29C 66/12445; B29C 66/131; B29C 66/5344; B29C 66/54; B29C 66/542; B29C 66/545; B29C 66/71; B29C 66/72341; B29C 66/73921; B29C 66/8242; B29C 66/8322; B29C 66/919; B29C 66/929; B29C 66/93451; B29C 66/939; B29C 66/9513; B29C 66/9517; B29C 69/004; B29K 2023/12; B29K 2055/02; B29K 2067/00; B29K 2069/00; B29L 2024/00; B29L 2031/7132; B29L 2031/74; B32B 15/09; B32B 15/14; B32B 15/18; B32B 2250/03; B32B 2262/02; B32B 2262/0276; B32B 2307/302; B32B 2307/304; B32B 2307/308; B32B 2307/54; B32B 2307/7145; B32B 2307/734; B32B 2307/752; B32B 2398/20; B32B 2439/00; B32B 2439/40; B32B 27/02; B32B 27/12; B32B 27/20; B32B 27/28; B32B 27/32; B32B 3/06; B32B 3/30; B32B 5/022; B32B 7/08; B65D 1/00; B65D 1/02; B65D 1/0207; B65D 1/0215; B65D 1/0223; B65D 1/0246; B65D 1/04; B65D 1/12; B65D 1/165; B65D 1/265; B65D 1/28; B65D 1/40; B65D 1/44; B65D 11/02; B65D 11/04; B65D 11/10; B65D 11/16; B65D 11/1833; B65D 13/02; B65D 15/02; B65D 17/08; B65D 17/4011; B65D 19/0002; B65D 19/0012; B65D 19/0016; B65D 19/06; B65D 19/18; B65D 19/20; B65D 19/38; B65D 21/02; B65D 21/0209; B65D 21/0213; B65D 21/0215; B65D 21/0228; B65D 21/0233; B65D 21/062; B65D 21/066; B65D 21/08; B65D 2201/00; B65D 2203/00; B65D 2203/10; B65D 2203/12; B65D 2205/02; B65D 2213/00; B65D 2231/02; B65D 2231/022; B65D 2251/0015; B65D 2251/0018; B65D 2251/0025; B65D 2251/0028; B65D 2251/0075; B65D 2251/0078; B65D 2251/0081; B65D 2251/0087; B65D 2251/009; B65D 2251/20; B65D 23/02; B65D 23/08; B65D 23/0885; B65D 23/16; B65D 2301/20; B65D 25/00; B65D 25/02; B65D 25/04; B65D 25/108; B65D 25/14; B65D 25/16; B65D 25/20; B65D 25/205; B65D 25/24; B65D 25/28; B65D 25/2817; B65D 25/2858; B65D 25/34; B65D 25/38; B65D 25/42; B65D 25/48; B65D 25/54; B65D 2501/0081; B65D 2517/0062; B65D 2519/00019; B65D 2519/00024; B65D 2519/00034; B65D 2519/00044; B65D 2519/00054; B65D 2519/00059; B65D 2519/00069; B65D 2519/00104; B65D 2519/00139; B65D 2519/00159; B65D 2519/00164; B65D 2519/00174; B65D 2519/00184; B65D 2519/00208; B65D 2519/00218; B65D 2519/00268; B65D 2519/00273; B65D 2519/00288; B65D 2519/00293; B65D 2519/00318; B65D 2519/00323; B65D 2519/00333; B65D 2519/00338; B65D 2519/00373; B65D 2519/00407; B65D 2519/00412; B65D 2519/00422; B65D 2519/00437; B65D 2519/00497; B65D 2519/00502; B65D 2519/00527; B65D 2519/00557; B65D 2519/00562; B65D 2519/00567; B65D 2519/00572; B65D 2519/00621; B65D 2519/00641; B65D 2519/00666; B65D 2519/00711; B65D 2519/008; B65D 2519/0086; B65D 2525/283; B65D 2543/00027; B65D 2543/00046; B65D 2543/00092; B65D 2543/00194; B65D 2543/00222; B65D 2543/00231; B65D 2543/00277; B65D 2543/00296; B65D 2543/00351; B65D 2543/0049; B65D 2543/00509; B65D 2543/00527; B65D 2543/00537; B65D 2543/00546; B65D 2543/00555; B65D 2543/0062; B65D 2543/00638; B65D 2543/00685; B65D 2543/00731; B65D 2543/00796; B65D 2543/00805; B65D 2543/00851; B65D 2543/00972; B65D 2565/385; B65D 2585/366; B65D 2590/046; B65D 3/06; B65D 3/12; B65D 3/14; B65D 3/22; B65D 3/28; B65D 31/02; B65D 31/04; B65D 31/10; B65D 33/00; B65D 33/2508; B65D 33/2541; B65D 39/08; B65D 41/023; B65D 41/04; B65D 41/0414; B65D 41/0435; B65D 41/0442; B65D 41/185; B65D 41/28; B65D 43/02; B65D 43/0202; B65D 43/0204; B65D 43/0206; B65D 43/021; B65D 43/0212; B65D 43/022; B65D 43/0222; B65D 43/0225; B65D 43/0227; B65D 43/0229; B65D 43/0231; B65D 43/16; B65D 43/162; B65D 43/163; B65D 43/166; B65D 43/167; B65D 43/22; B65D 45/16; B65D 47/06; B65D 47/0895; B65D 47/121; B65D 47/122; B65D 47/142; B65D 47/2031; B65D 47/265; B65D 47/286; B65D 47/32; B65D 5/00; B65D 5/12; B65D 5/2033; B65D 5/2047; B65D 5/22; B65D 5/241; B65D 5/248; B65D 5/302; B65D 5/321; B65D 5/36; B65D 5/40; B65D 5/42; B65D 5/4204; B65D 5/4266; B65D 5/4295; B65D 5/44; B65D 5/443; B65D 5/5021; B65D 5/5035; B65D 5/563; B65D 5/62; B65D 5/66; B65D 5/6664; B65D 5/6667; B65D 5/667; B65D 5/68; B65D 51/16; B65D 51/1683; B65D 51/18; B65D 51/20; B65D 51/24; B65D 51/242; B65D 51/248; B65D 51/28; B65D 51/2864; B65D 53/00; B65D 53/02; B65D 53/08; B65D 55/16; B65D 65/38; B65D 65/40; B65D 65/403; B65D 65/406; B65D 65/46; B65D 65/466; B65D 7/04; B65D 7/22; B65D 7/36; B65D 75/008; B65D 75/26; B65D 75/5805; B65D 75/5838; B65D 77/02; B65D 77/04; B65D 77/0466; B65D 77/06; B65D 77/067; B65D 77/2024; B65D 81/03; B65D 81/05; B65D 81/052; B65D 81/18; B65D 81/2023; B65D 81/2038; B65D 81/2076; B65D 81/24; B65D 81/245; B65D 81/261; B65D 81/264; B65D 81/266; B65D 81/267; B65D 81/268; B65D 81/28; B65D 81/30; B65D 81/32; B65D 81/3216; B65D 81/3222; B65D 81/34; B65D 81/3453; B65D 81/3484; B65D 81/36; B65D 81/365; B65D 81/38; B65D 81/3802; B65D 81/3806; B65D 81/3811; B65D 81/3813; B65D 81/3816; B65D 81/3818; B65D 81/382; B65D 81/3823; B65D 81/3825; B65D 81/3827; B65D 81/383; B65D 81/3834; B65D 81/3837; B65D 81/3841; B65D 81/3844; B65D 81/3846; B65D 81/3848; B65D 81/3853; B65D 81/3858; B65D 81/3862; B65D 81/3865; B65D 81/3869; B65D 81/3874; B65D 81/3876; B65D 81/3879; B65D 81/3881; B65D 81/3883; B65D 81/3886; B65D 81/3893; B65D 81/3895; B65D 81/3897; B65D 83/38; B65D 83/384; B65D 83/42; B65D 83/62; B65D 83/64; B65D 83/673; B65D 83/771; B65D 85/00; B65D 85/07; B65D 85/10; B65D 85/1018; B65D 85/1045; B65D 85/20; B65D 85/34; B65D 85/50; B65D 85/72; B65D 85/816; B65D 88/005; B65D 88/02; B65D 88/022; B65D 88/121; B65D 88/128; B65D 88/14; B65D 88/1668; B65D 88/1687; B65D 88/26; B65D 88/28; B65D 88/526; B65D 88/528; B65D 88/54; B65D 88/72; B65D 88/74; B65D 88/744; B65D 88/745; B65D 88/748; B65D 88/76; B65D 88/78; B65D 90/00; B65D 90/02; B65D 90/022; B65D 90/023; B65D 90/027; B65D 90/028; B65D 90/04; B65D 90/046; B65D 90/06; B65D 90/08; B65D 90/105; B65D 90/12; B65D 90/22; B65D 90/24; B65D 90/325; B65D 90/48; B65D 90/501; B65D 90/503; B65D 90/505; B65D 90/587; C08K 2003/2206; C08K 2003/265; C08K 3/18; C08K 3/26; C08L 23/10; F25D 2303/0822; F25D 2303/08222; F25D 2303/0831; F25D 2303/0841; F25D 2303/0842; F25D 2303/0843; F25D 2303/0845; F25D 2303/085; F25D 2331/803; F25D 2331/808; F25D 2400/36; F25D 2500/02; F25D 3/08; Y10S 220/916

USPC ..... 156/145; 206/0.5, 0.6, 0.7, 1.5, 1.7, 139, 206/14, 141, 147, 162, 188, 203, 204, 206/205, 213.1, 216, 217, 219, 221, 222, 206/223, 232, 233, 245, 264, 268, 273, 206/274, 286, 3, 303, 305, 306, 308.1, 206/308.2, 314, 315.1, 315.11, 315.3, 206/319, 320, 321, 349, 363, 37, 370, 206/372, 373, 38, 386, 387.1, 387.11, 206/387.13, 387.15, 388, 394, 397, 408, 206/409, 423, 426, 427, 428, 434, 438, 206/439, 440, 445, 446, 447, 449, 454, 206/455, 457, 459.1, 459.5, 470, 472, 206/484, 484.2, 485, 486, 493, 494, 497, 206/499, 501, 503, 505, 508, 509, 510, 206/511, 512, 514, 515, 518, 519, 520, 206/521, 522, 523, 524.1, 524.2, 524.3, 206/524.4, 524.6, 524.7, 524.8, 525, 527, 206/535, 541, 542, 543, 544, 545, 546, 206/549, 557, 562, 563, 564, 569, 570, 206/581, 591, 594, 595, 597, 599, 600, 206/701, 703, 710, 807, 818, 831; 215/10, 11.1, 11.2, 11.3, 11.4, 11.5, 11.6, 215/12.1, 12.2, 13.1, 200, 201, 202, 204, 215/206, 207, 215, 216, 217, 218, 220, 215/222, 227, 228, 229, 230, 231, 232, 215/233, 235, 237, 247, 248, 249, 250, 215/251, 252, 253, 254, 256, 258, 260, 215/261, 262, 263, 270, 271, 272, 274, 215/276, 277, 278, 295, 302, 303, 305, 215/306, 307, 308, 309, 311, 312, 315, 215/316, 317, 318, 320, 321, 329, 330, 215/331, 332, 337, 341, 343, 344, 345, 215/347, 349, 350, 352, 354, 355, 356, 215/364, 373, 376, 379, 381, 382, 383, 215/384, 386, 387, 388, 390, 395, 396, 215/398, 40, 43, 44, 45, 48, 6, 901, 902, 215/DIG. 1, DIG. 3, DIG. 8

See application file for complete search history.

(56) References Cited

FOREIGN PATENT DOCUMENTS

| | | | | | |
|---|---|---|---|---|---|
| DE | 202013105855 | U1 | * | 1/2014 | ..... B65D 81/3841 |
| GB | 2236174 | A | * | 3/1991 | ..... A45C 7/005 |
| JP | 3193635 | U | * | 10/2014 | ..... B65D 81/3841 |
| KR | 20200088660 | A | * | 7/2020 | ..... B01J 20/18 |
| TW | 462243 | U | * | 9/2013 | ..... A47J 41/022 |
| WO | WO-2004089175 | A1 | * | 10/2004 | ..... B65D 23/16 |

* cited by examiner

CONTAINER ASSEMBLY AND CONTAINER LID

CROSS-REFERENCE TO RELATED PATENT APPLICATION

This application is a Continuation-In-Part of the U.S. application Ser. No. 18/319,496, filed on May 18, 2023, and entitled "CONTAINER ASSEMBLY AND CONTAINER LID," which is a Continuation-In-Part of the U.S. application Ser. No. 17/540,165, filed on Dec. 1, 2021, and entitled "CONTAINER ASSEMBLY AND CONTAINER LID," now pending. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a container assembly and a container lid, and more particularly to a container assembly and a container lid for a user to carry beverage or water.

BACKGROUND OF THE DISCLOSURE

With the recent pursuit of environmental protection and attempts at decreasing the use of disposable plastic containers, use of thermos bottles or tumblers for carrying water or beverages has become a trend in modern society. In addition, in order to reduce the use of plastic straws, people use reusable straw made of metal or plastic to drink water or beverages.

However, when a conventional thermos bottle is used with a straw, if the straw is too short in length, the entire straw tends to sink inside of a container after the straw is inserted into the container. When the straw needs to be used, the straw must be pulled out from an opening of the container with fingers. Therefore, the use of the straw can be inconvenient, and grasping the straw with fingers can cause the straw to be contaminated.

If a length of the straw is greater than a height of the opening of the container, when the straw is inserted into the container, an upper end of the straw protrudes from a top end of the opening of the container. When the container is closed by a lid thereof, the lid of the container interferes with the upper end of the straw. Accordingly, before the container is closed by the lid, the straw is required to be taken out and stored outside of the container, such that the use of the straw with a lidded container is not convenient. Furthermore, the straw may be easily contaminated, thereby affecting sanitation.

According to the above reasons, it is inconvenient to use a conventional container with the straw. Therefore, the conventional container still has room for improvement in light of the abovementioned issues.

SUMMARY OF THE DISCLOSURE

In response to the above-referenced technical inadequacies, the present disclosure provides a container assembly and a container lid to improve on issues relating to the inconveniences of a conventional container and straw.

In one aspect, the present disclosure provides a container assembly. The container assembly includes a container body, a lid. The container body has an accommodating space formed therein. The container body defines a longitudinal direction, two ends of the container body along the longitudinal direction are respectively defined as an upper end and a bottom end, and the container body has an enclosed bottom portion at the bottom end and an opening portion at the upper end. The lid is detachably disposed on the opening portion of the container body. The lid has an outer lid portion, an inner lid portion, and a connection portion that is connected to the outer lid portion and the inner lid portion, and the outer lid portion, the inner lid portion, and the connection portion jointly define a first heat insulation space. The connection portion has an annular abutting section, an enclosed end section, and an outer thread section arranged between the annular abutting section and the enclosed end section, and a distance between the enclosed end section and the annular abutting section is less than a distance between the enclosed end section and an inner lid top board of the inner lid portion. When the lid is disposed on the opening portion, an inner thread section of the opening portion and the outer thread section of the connection portion are locked with each other, and the annular abutting section abuts against an upper end edge of the opening portion. The plastic thread has an annular base portion and at least one annular thread protrusion that is integrally formed on the annular base portion, and the annular base portion is shaped in a hollow cylinder with an even thickness. The opening portion has an upper half section and a lower half section that is connected to the upper half section. The plastic thread is contacted with the upper half section of the opening portion. The enclosed end section is contacted with the lower half section of the opening portion.

In another aspect, the present disclosure provides a container lid. The container lid includes a lid. The lid is disposed on an opening portion of a container body. The container body has an accommodating space formed therein, and the lid is detachably disposed on the opening portion. The lid has an outer lid portion, an inner lid portion, and a connection portion that is connected to the outer lid portion and the inner lid portion, and the outer lid portion, the inner lid portion, and the connection portion jointly define a first heat insulation space. The connection portion has an annular abutting section, an enclosed end section, and an outer thread section arranged between the annular abutting section and the enclosed end section, and a distance between the enclosed end section and the annular abutting section is less than a distance between the enclosed end section and an inner lid top board of the inner lid portion. The container lid is applicable for a thermobottle. The plastic thread has an annular base portion and at least one annular thread protrusion that is integrally formed on the annular base portion, and the annular base portion is shaped in a hollow cylinder with an even thickness. The opening portion has an upper half section and a lower half section that is connected to the upper half section. The plastic thread is contacted with the upper half section of the opening portion. The enclosed end section is contacted with the lower half section of the opening portion. Therefore, in the container assembly and the container lid provided by the present disclosure, by virtue of "the container assembly including the container body, the lid, and the straw" and "a height of the annular pressing portion being between a height of a bottom surface of the top portion of the lid and a height of a bottom surface of the sleeved portion, and a gap being between the annular pressing portion and the bottom surface of the top portion," the inconveniences of the conventional container can be overcome.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
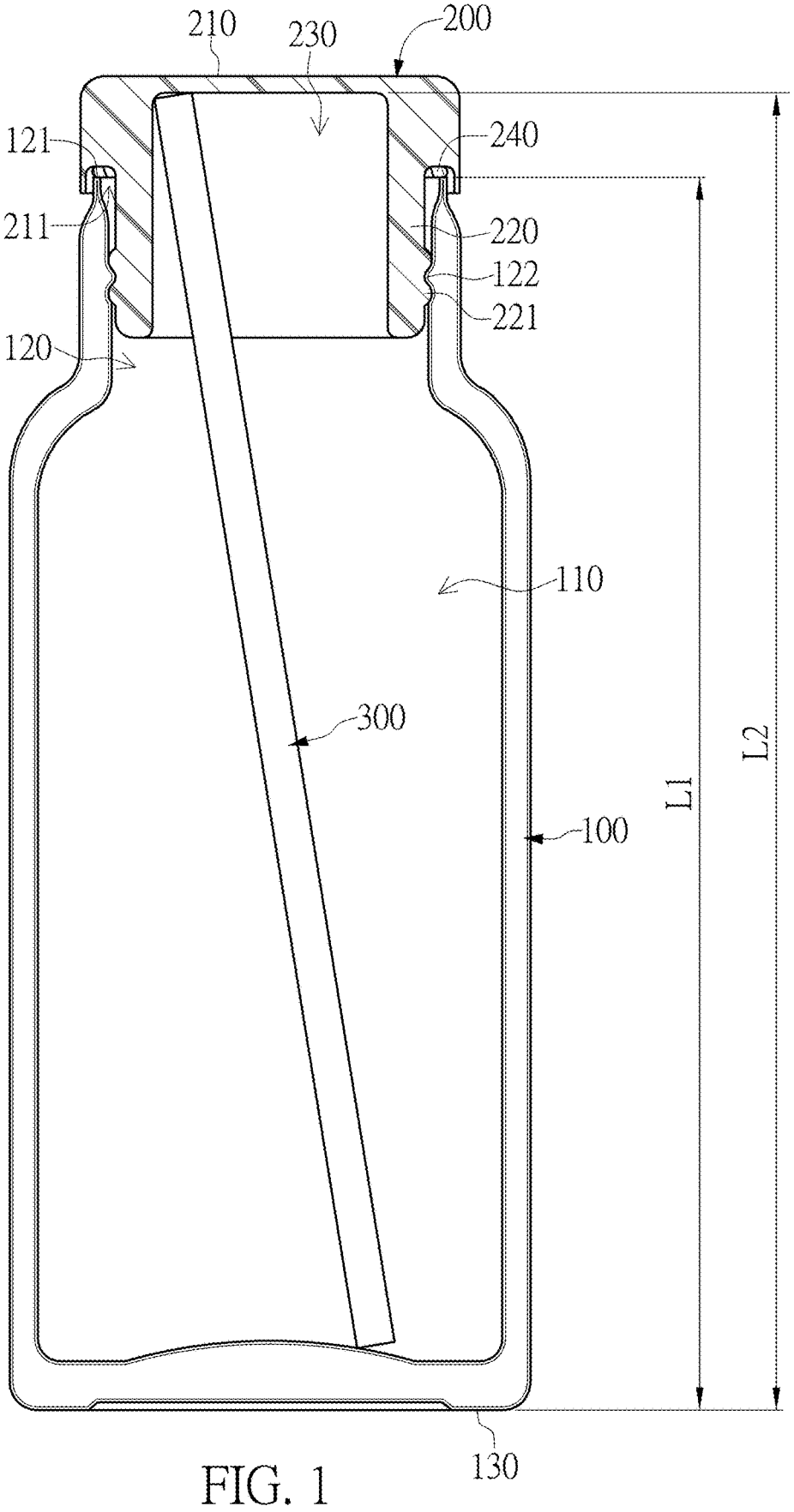
FIG. 1 is a schematic assembled cross-sectional view of a container assembly according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
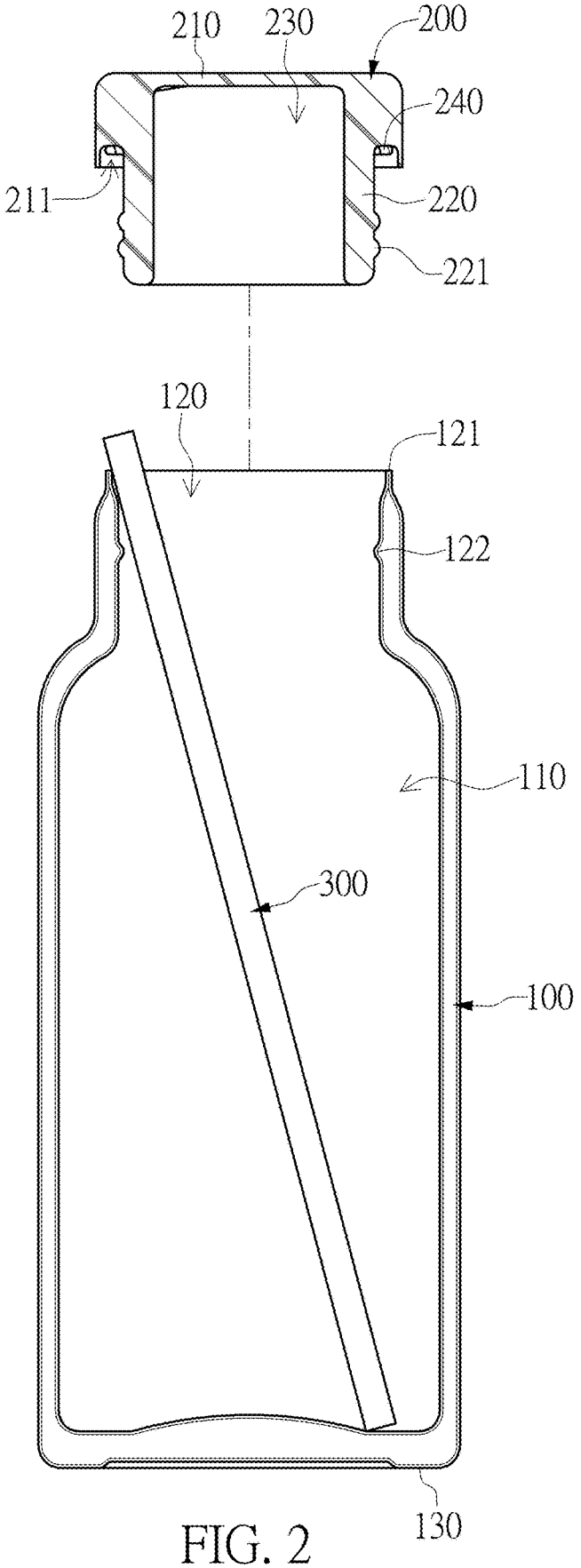
FIG. 2 is a schematic cross-sectional exploded view of a lid and a container body according to the first embodiment of the present disclosure.
Figure 3:
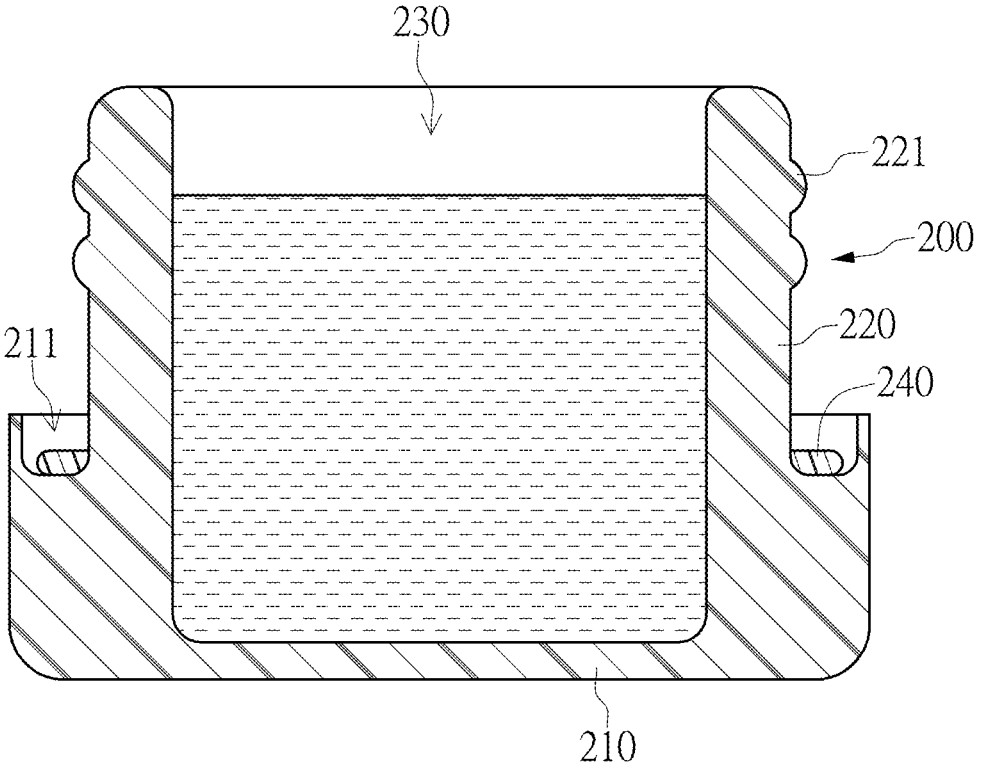
FIG. 3 is a schematic view of the lid being used as a cup according to the first embodiment of the present disclosure.

Referring to FIG. 1 to FIG. 3, a first embodiment of the present disclosure provides a container assembly including a container body 100, a lid 200, and a straw 300 that is accommodated in the container body 100 and the lid 200.

The container body 100 is in a barrel shape. In an exemplary embodiment of the present disclosure, the container body 100 can be a vacuum insulating container made of metal boards, and the container body 100 can reduce heat conduction through vacuum insulation to achieve a heat preservation effect (i.e., keeping items inside of the container body 100 warm or cold), but the container body 100 of the present disclosure is not limited thereto, and can be made of other materials. For example, the container body 100 can be an insulating container made of plastic, ceramic, or glass.

The container body 100 has an accommodating space 110 formed therein. The container body 100 defines a longitudinal direction, two ends of the container body 100 along the longitudinal direction are respectively defined as an upper end and a bottom end, the container body 100 has an enclosed bottom portion 130 at the bottom end and an opening portion 120 at the upper end.

The lid 200 is detachably disposed on the opening portion 120 of the container body 100, so that the accommodating space 110 inside of the container body 100 is sealed, and beverage or liquid accommodated in the accommodating space 110 does not leak from the opening portion 120.

The lid 200 has a top portion 210 at an upper end thereof, and the lid 200 has a sleeved portion 220 connected below the top portion 210. In the present embodiment, the sleeved portion 220 is substantially in a circular column shape, and the sleeved portion 220 can be sleeved around an inner side of the opening portion 120. The opening portion 120 has a first screw thread portion 122 at an inner side wall thereof, and the sleeved portion 220 has a second screw thread portion 221 corresponding to the first screw thread portion 122 at an outer side wall of the sleeved portion 220. The first screw thread portion 122 and the second screw thread portion 221 can be screwed with each other, so that the sleeved portion 220 can be tightly screwed at the inner side of the opening portion 120.

In the present embodiment, the sleeved portion 220 has a second accommodating space 230 formed therein, and the second accommodating space 230 is recessed from a center of a bottom portion of the sleeved portion 220 and faces toward the top portion 210. An annular pressing portion 211 is formed at an outer side surface of the sleeved portion 220, the annular pressing portion 211 extends along a direction perpendicular to the longitudinal direction, and a sealing washer 240 is disposed on the annular pressing portion 211. When the lid 200 is disposed on the opening portion 120, the sealing washer 240 of the annular pressing portion 211 and an upper end edge 121 of the opening portion 120 are engaged with each other in a sealed state, so that the opening portion 120 is closed.

It is worth mentioning that the structure of the sleeved portion 220 is not limited to those shown in the figures of the present embodiment. For example, the sleeved portion 220 can be sleeved around an outer side surface of the opening portion 120. When the sleeved portion 220 is changed to be sleeved around the outer side surface of the opening portion 120, the annular pressing portion 211 can be changed to be formed at an inner side of the sleeved portion 220. In addition, a fixing structure other than the first screw thread 122 and the second screw thread 221 can be used between the sleeved portion 220 and the opening portion 120. For example, the sleeved portion 220 and the opening portion 120 can be engaged with each other through a buckle, or the sleeved portion 220 can be fixed on the opening portion 120 through elastic engagement.

Referring to FIG. 1 and FIG. 2, by the design of the lid 200, a height of the annular pressing portion 211 is between a height of a bottom surface of the top portion 210 of the lid and a height of a bottom surface of the sleeved portion 220, and a gap is defined between the annular pressing portion 211 and the bottom portion of the top portion 210. Therefore, as shown in FIG. 1, when the lid 200 is covered on the opening portion 120 of the container body 100, since the bottom surface of the top portion 210 is higher than the annular pressing portion 211, a gap can be maintained between the bottom surface of the top portion 210 and the upper end edge 121 of the opening portion 120. In other words, when the lid 200 is disposed on the opening portion 120, a top portion of the second accommodating space 230 is higher than the upper end edge of the opening portion 120 of the container body 100.

For ease of description, a distance from the bottom surface of the container body 100 to the upper end edge of the opening portion 120 is defined as a first length, and when the lid 200 is disposed on the opening portion 120 of the container body 100, a distance between the bottom surface of the container body 100 and the bottom surface of the top portion 210 of the lid 200 is defined as a second length. The second length is greater than the first length.

As shown in FIG. 1 and FIG. 2, the straw 300 is accommodated between the container body 100 and the lid 200. In the present embodiment, the straw 300 is an unbendable and reusable straw. The straw 300 can be one of a metal straw, a glass straw, and a plastic straw. In an exemplary embodiment, the straw 300 can be made of titanium.

A length of the straw 300 is between the first length and the second length. In other words, when the straw 300 is inserted into the container body 100, an upper end of the straw 300 protrudes from the upper end edge (as shown in FIG. 2) of the opening portion 120. When the straw 300 is inserted into the container body 100 and the lid 200 covers the opening portion 120 (as shown in FIG. 1), the upper end of the straw 300 can extend to a position in the second accommodating space 230 higher than a top end of the opening portion 120, and a height of the upper end of the straw 300 is lower than the bottom surface of the top portion 210 of the lid 200.

It should be noted that, the straw 300 is exemplified in the embodiment of the present disclosure, but the container body 100 and the lid 200 of the present disclosure can be used in cooperation with other rod-shaped structures (e.g., a stirring rod or a spoon).

In an exemplary embodiment of the present disclosure, when the lid 200 covers on the opening portion 120, a gap between a top end of the second accommodating space 230 and the upper end edge 121 of the opening portion 120 is within a range from 5 mm to 50 mm, and when the straw 300 is inserted into the accommodating space 110 of the container body 100, a length of an upper portion of the straw 300 that protrudes from the opening portion 120 is within a range from 5 mm to 50 mm. Through the above configuration, the distance where the upper end of the straw 300 protrudes from the opening portion 120 is suitable for a user to directly suck on the straw 300 with the mouth, and the length of the upper end of the straw 300 protruding from the opening portion 120 can cooperate with a height of the second accommodating space 230, so that the upper portion of the straw 300 can be accommodated in the second accommodating space 230.

Therefore, through the above configuration of the present disclosure, when the straw 300 is inserted in the container body 100, and the lid 200 covers the opening portion 120, the upper end of the straw 300 does not interfere with the lid 200, and in the container assembly of the present disclosure, the lid 200 can cover the top end of the container body 100 without having to take out the straw 300. When the user wants to drink the beverage or water in the container body 100, the user only needs to open the lid 200 such that the upper end of the straw 300 is directly exposed from the top end of the opening portion 120, and the user is not required to pull at the straw 300 in the container body 100 with their fingers.

In addition, the second accommodating space 230 of the lid 200 of the present disclosure has enough volume to accommodate beverage or water poured out from the container body 100. Therefore, as shown in FIG. 3, after the lid 200 of the present disclosure is taken off from the container body 100, the lid 200 can be disposed upside down. Accordingly, water or beverage can be poured into the second accommodating space 230 of the lid 200, and the lid 200 can be used as a cup.

However, the aforementioned description for the container assembly and the lid 200 of the first embodiment are merely an example, and are not meant to limit the scope of the present disclosure.

Second Embodiment

Figure 4:
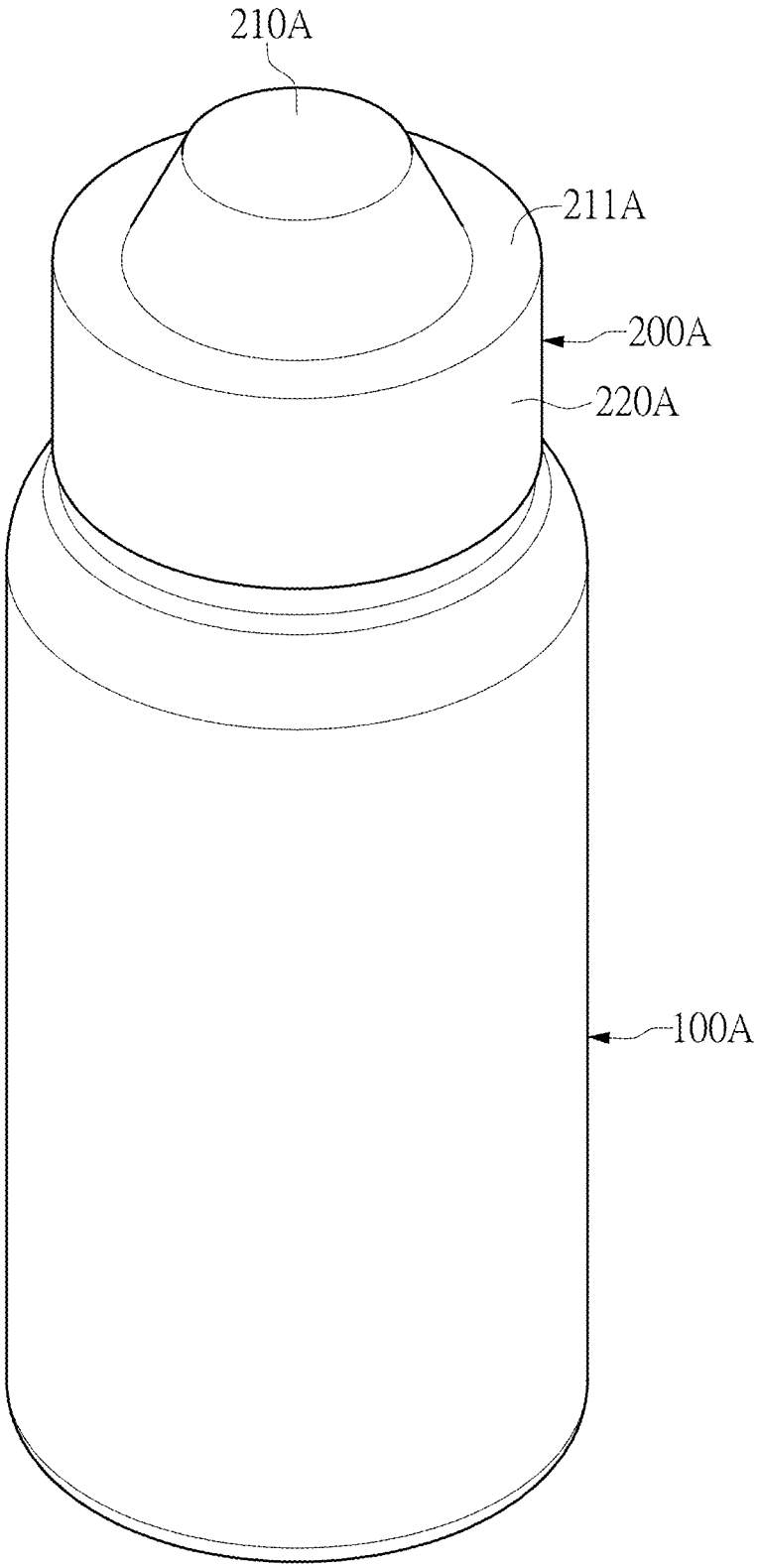
FIG. 4 is a schematic perspective view of the container assembly according to a second embodiment of the present disclosure.
Figure 5:
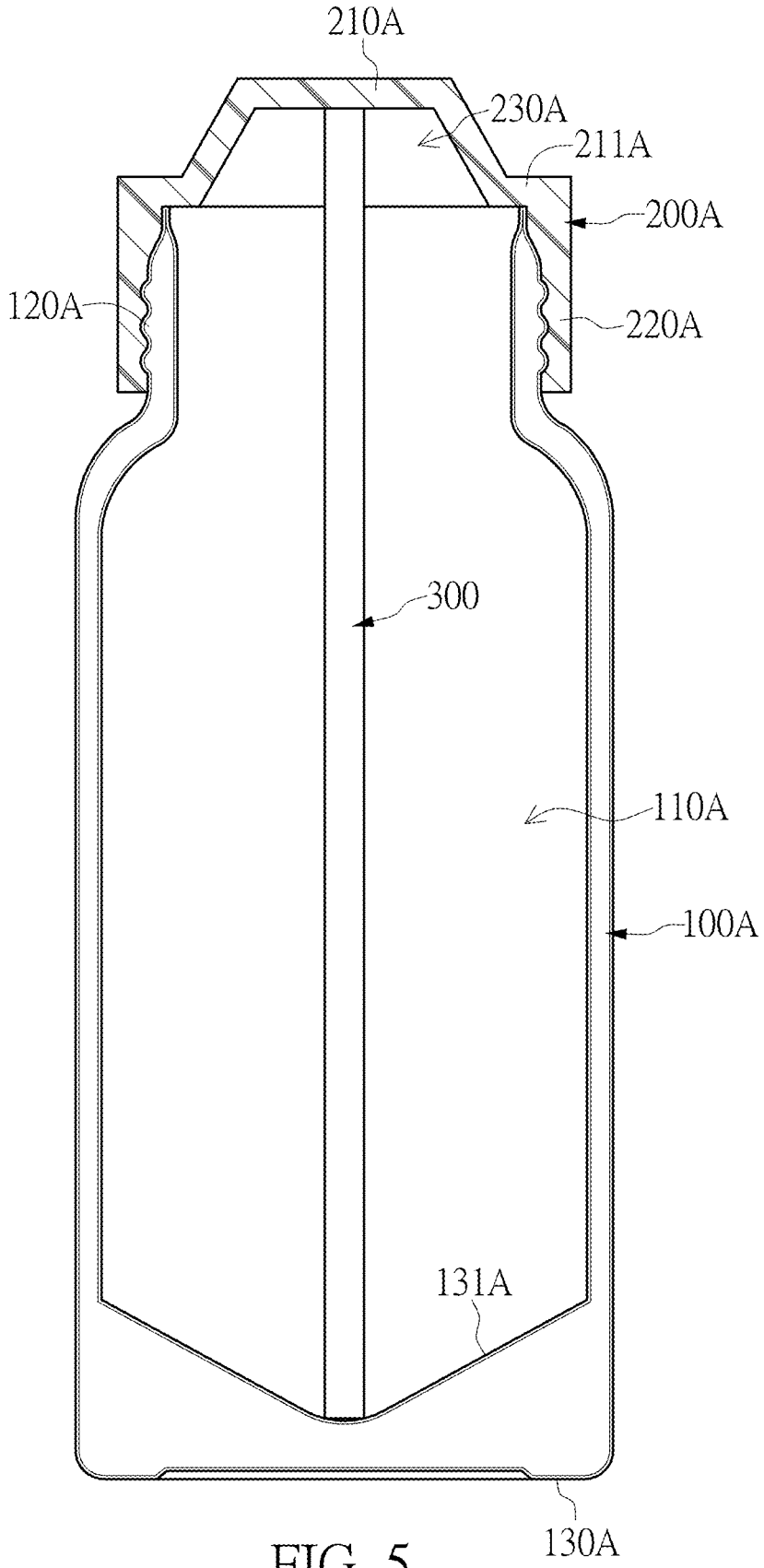
FIG. 5 is a schematic sectional view of the container assembly according to the second embodiment of the present disclosure.

Referring to FIG. 4 to FIG. 5, FIG. 4 and FIG. 5 show a second embodiment of the present disclosure. It should be noted that the present embodiment is similar to the above-mentioned first embodiment, and the same parts of the first embodiment and the second embodiment will not be reiterated herein.

In the present embodiment, the container assembly includes a container body 100A and a lid 200A. The lid 200A has a sleeved portion 220A that is configured to be engaged with an opening portion 120A of the container body 100A. The lid 200A has an annular pressing portion 211A extending inwards at an upper end of the sleeved portion 220A. The lid 200A has a top portion 210A that is convex at a top end of the annular pressing portion 211A. In the present embodiment, the top portion 210A is a conical protrusion that protrudes from a top surface of the annular pressing portion 211A, and a second accommodating space 230A is defined below the top portion 210A. When the lid 200A is disposed on the opening portion 120A of the container body 100A, a height of the second accommodating space 230A is greater than a height of the opening portion 120A, so that the upper end of the straw 300 can be accommodated in the second accommodating space 230A.

In addition, in the present embodiment, the container body 100A has a concave portion 131A that is sunken downwardly at the bottom portion 130A thereof in the accommodating space 110A. The lowest point of the concave portion 131A is located at a center position of the bottom portion 130A of the container body 100A in the accommodating space 110A. Through the concave portion 131A, chewables (e.g., tapioca balls, konjac, or jelly) in the beverage can be concentrated and precipitated at the bottom portion 130A, so that the chewables can be easily sucked up by using the straw 300.

However, the aforementioned description for the container assembly and the lid 200A of the second embodiment are merely an example, and are not meant to limit the scope of the present disclosure.

Third Embodiment

Figure 6:
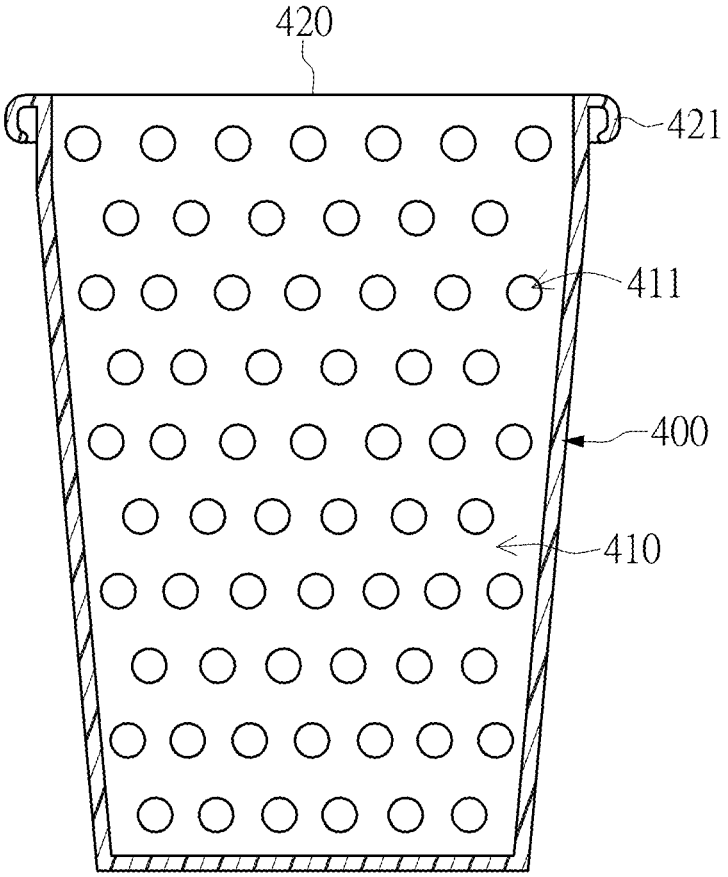
FIG. 6 is a schematic cross-sectional view of a lid accessory according to a third embodiment of the present disclosure.
Figure 7:
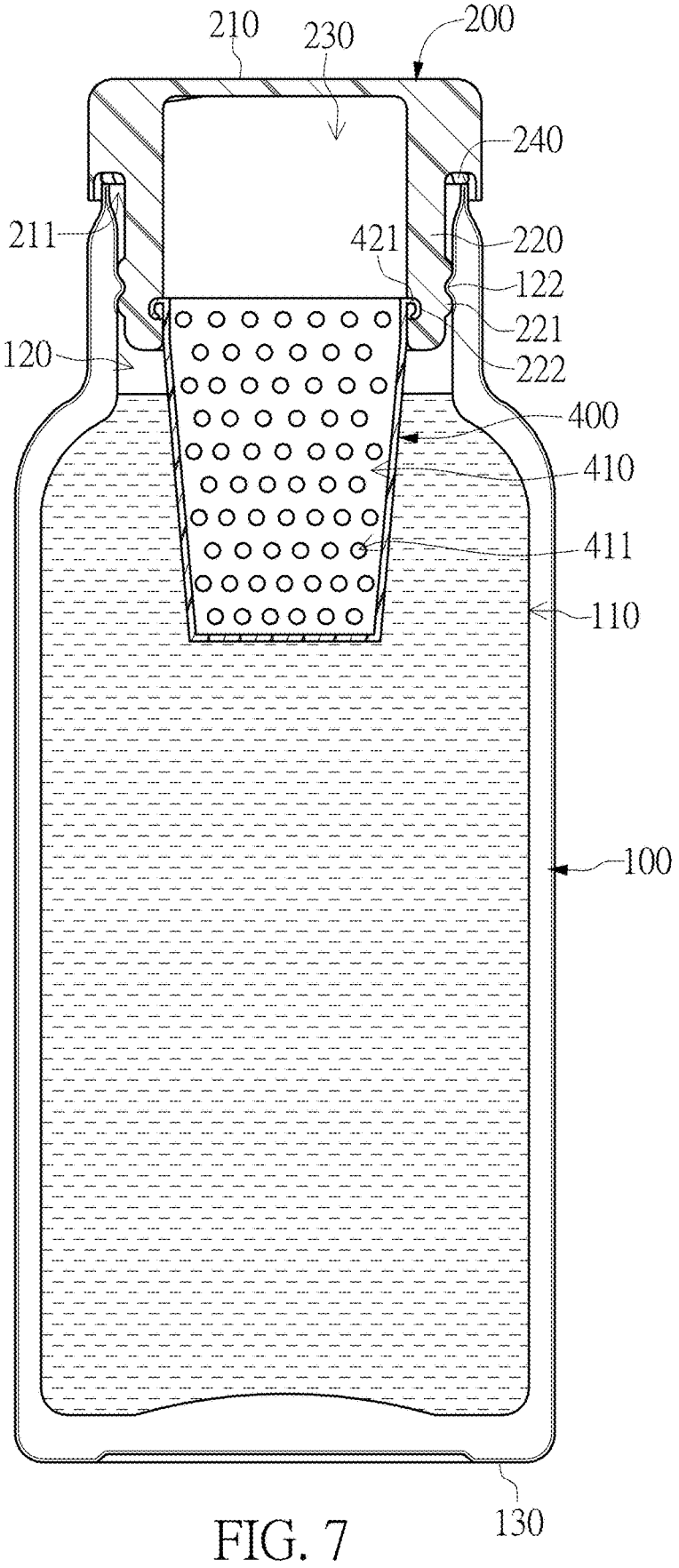
FIG. 7 is a schematic assembled sectional view of the container assembly according to the third embodiment of the present disclosure.
Figure 8:
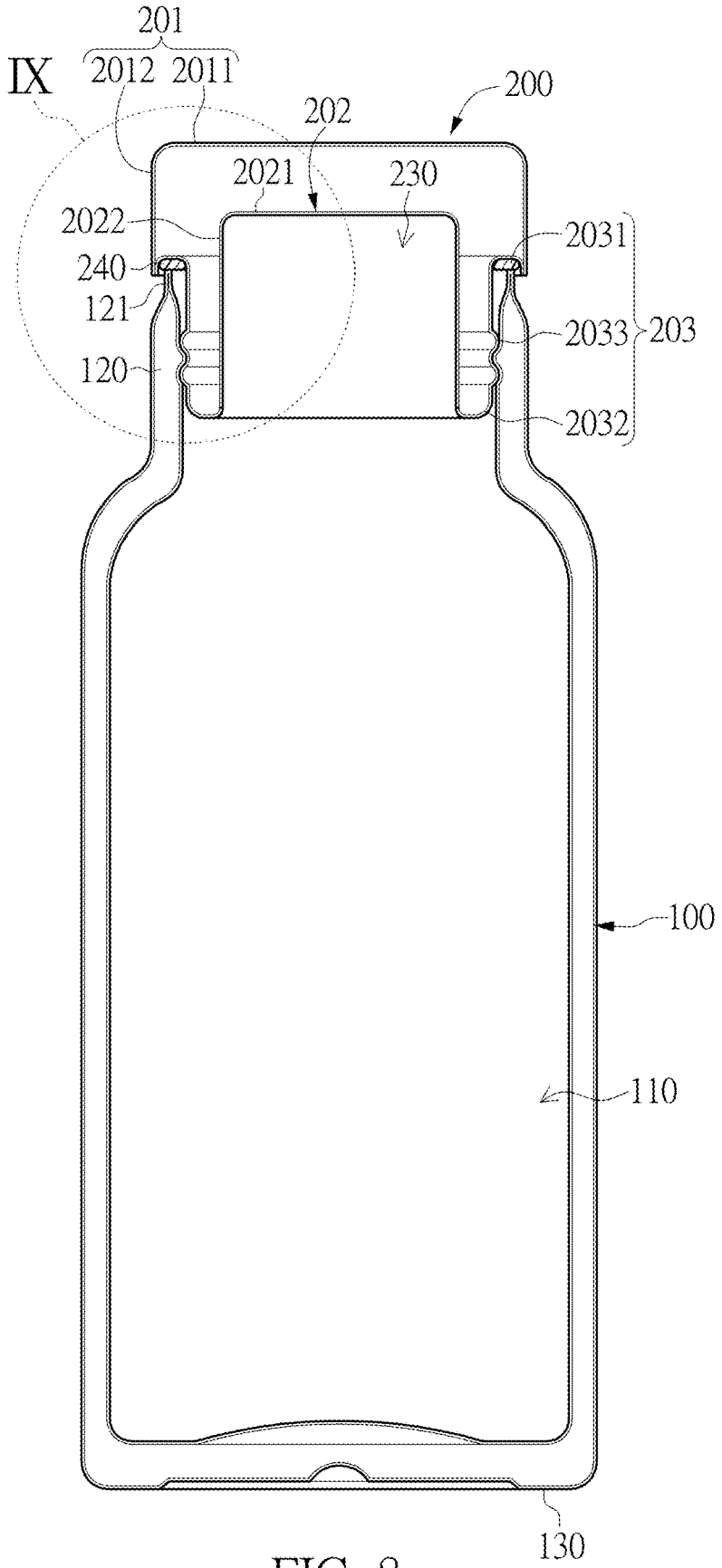
FIG. 8 is a schematic assembled cross-sectional view of a container assembly omitting a straw according to a fourth embodiment of the present disclosure.
Figure 9:
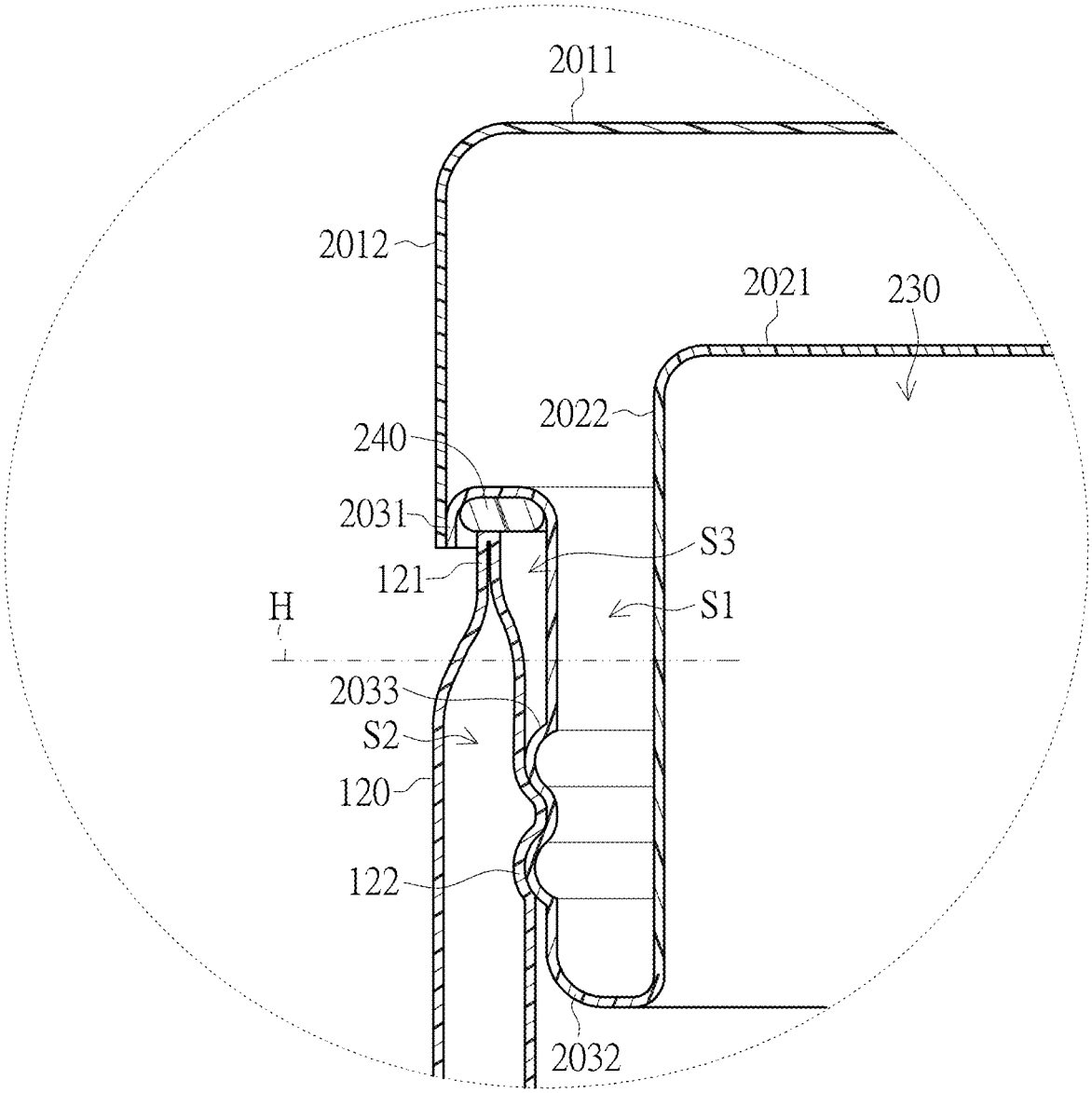
FIG. 9 is a partial enlarged view of FIG. 8.
Figure 10:
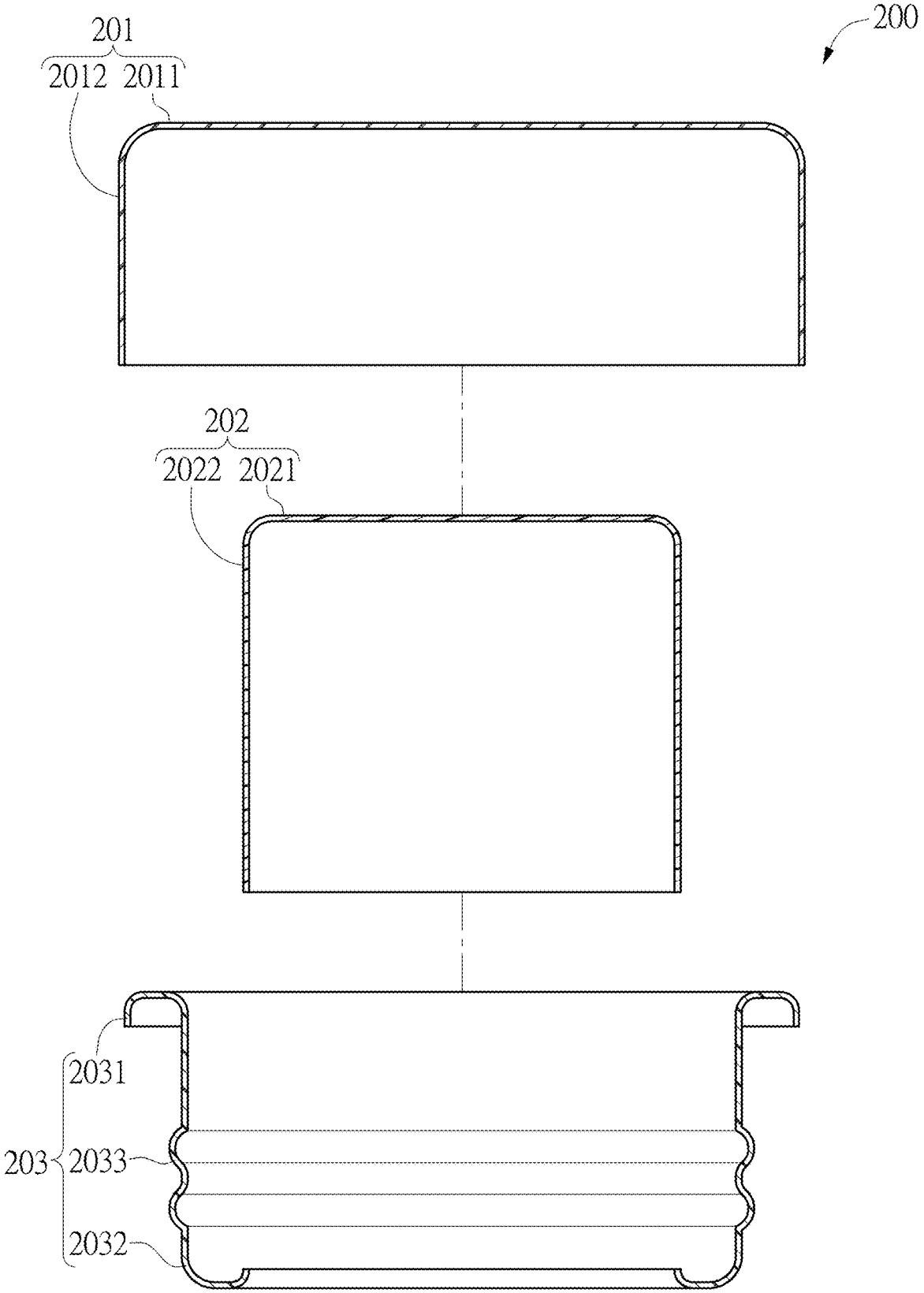
FIG. 10 is an exploded view of a lid according to the fourth embodiment of the present disclosure.
Figure 11:
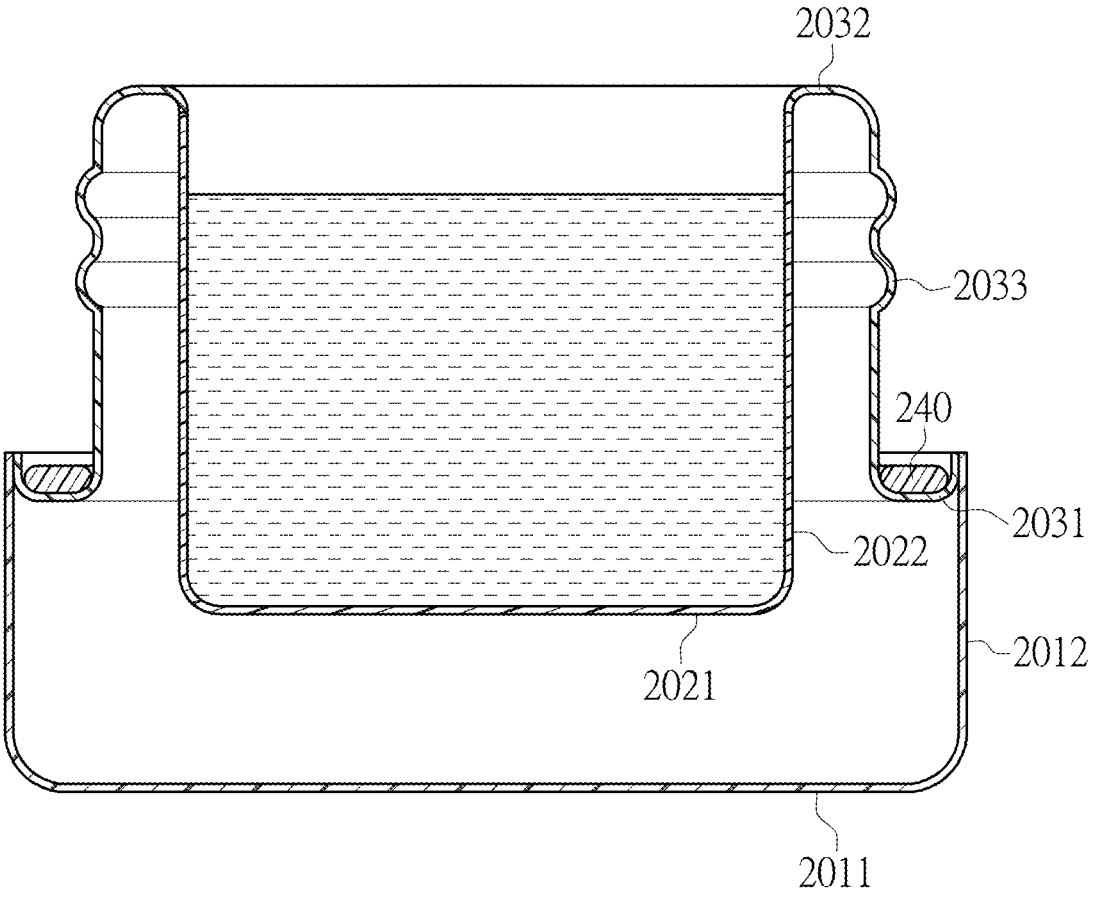
FIG. 11 is a schematic view of the lid being used as a cup according to the fourth embodiment of the present disclosure.
Figure 12:
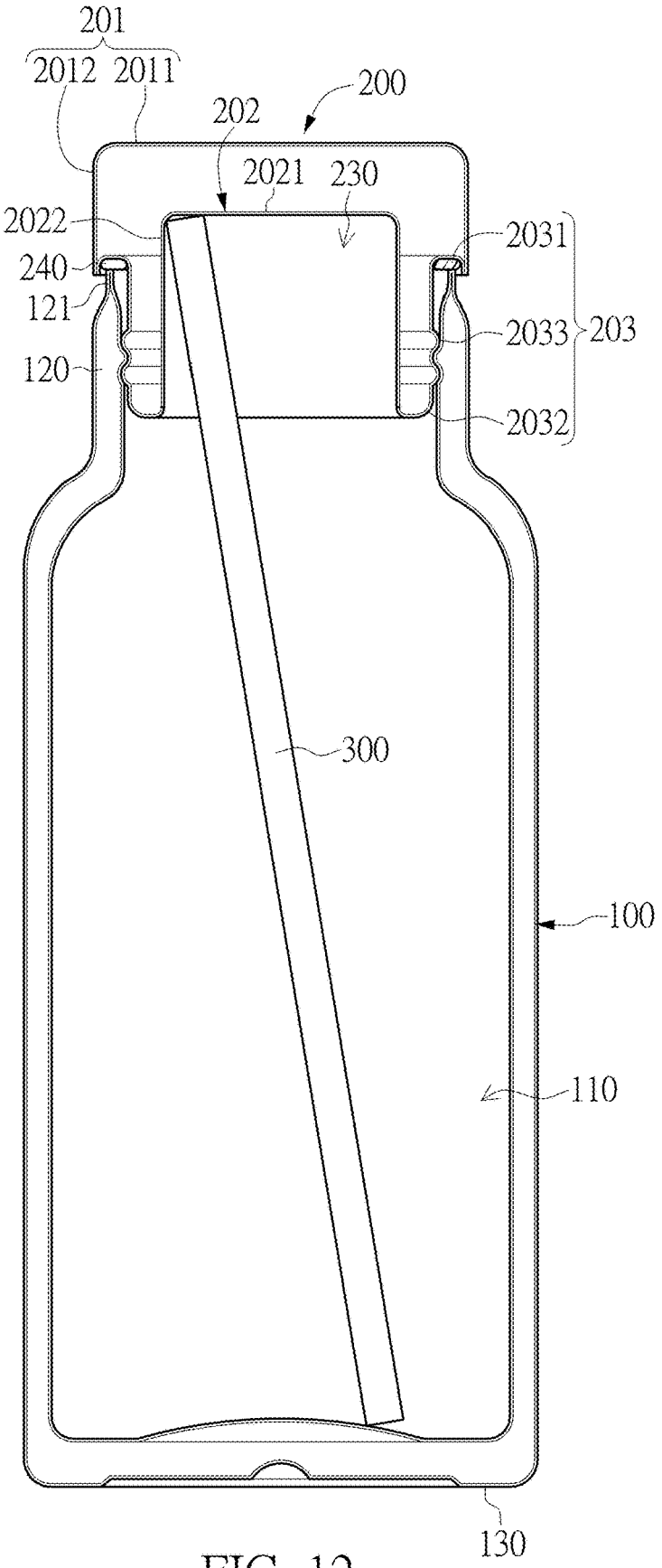
FIG. 12 is a schematic assembled cross-sectional view of the container assembly according to the fourth embodiment of the present disclosure.

Referring to FIG. 6 to FIG. 7, FIG. 6 and FIG. 7 show a third embodiment of the present disclosure. It should be noted that the present embodiment is similar to the above-mentioned first embodiment, and the same parts of the first embodiment and the third embodiment will not be reiterated herein.

In the present embodiment, the sleeved portion 220 of the lid 200 has a first engaging portion 222 at a bottom portion thereof. A lid accessory 400 has a second engaging portion 421 corresponding to the first engaging portion 222. The second engaging portion 421 and the first engaging portion 222 can be engaged with each other, so that the lid accessory 400 can be connected below the second accommodating space 230.

More specifically, in the present embodiment, the lid accessory 400 is an accommodating cup body 420. The accommodating cup body 420 defines a third accommodating space 410 therein. The third accommodating space 410 in the accommodating cup body 420 can be a space for storing a brewing material (e.g., tea leaves, brewing powders, and herbs from traditional Chinese medicine), so that a user can store the brewing material in the third accommodating space 410. In addition, in the present embodiment, the accommodating cup body 420 is made of metal board, and the accommodating cup body 420 can have a plurality of holes 411 formed by stamping, so that water in the accommodating space 110 of the container body 100 can enter into the third accommodating space 410. The second engaging portion 421 is flange-shaped and formed at an outer edge of an upper end of the accommodating cup body 420.

The first engaging portion 222 is an annular groove formed at a bottom portion of an inner side wall of the sleeved portion 220 of the lid 200, the second engaging portion 421 can be engaged in the first engaging portion 222, so that the lid accessory 400 can be hung below the second accommodating space 230 of the lid 200.

In the present embodiment, the lid accessory 400 can be used as a container for brewing tea leaves or drink additives. It should be noted that, the lid accessory 400 of the present disclosure is not limited to that shown in FIG. 6 and FIG. 7. The lid accessory 400 can be an accessory having other shapes or functions, for example, the lid accessory 400 can be a small water filter or a device for adjusting water quality.

In addition, the structure of the first engaging portion 222 and the structure of the second engaging portion 421 are not limited to those shown in FIG. 6 and FIG. 7. For example, in other embodiments of the present disclosure, the first engaging portion 222 and the second engaging portion 421 can be screw threads or quick fasteners, etc.

However, the aforementioned description for the container assembly and the lid 200 of the third embodiment are merely an example, and are not meant to limit the scope of the present disclosure.

Fourth Embodiment

Referring to FIG. 8 to FIG. 12, FIG. 8 to FIG. 12 show a fourth embodiment of the present disclosure. It should be noted that the present embodiment is similar to the above-mentioned first embodiment, and the same parts of the first embodiment and the fourth embodiment will not be reiterated herein.

In the present embodiment, the lid 200 has an outer lid portion 201, an inner lid portion 202, and a connection portion 203 that is connected to the outer lid portion 201 and the inner lid portion 202, and the outer lid portion 201, the inner lid portion 202, and the connection portion 203 jointly define a first heat insulation space S1. In other words, in the present embodiment, the lid 200 is hollow.

The connection portion 203 can be connected to the outer lid portion 201 and the inner lid portion 202 in a soldering manner, or the connection portion 203, the outer lid portion 201, and the inner lid portion 202 can be integrally formed, and the present disclosure does not limit the manner in which the connection portion 203 is connected to the outer lid portion 201 and the inner lid portion 202.

Specifically, the outer lid portion 201 has an outer lid top board 2011 and an outer annular wall 2012 connected to the outer lid top board 2011, the inner lid portion 202 has an inner lid top board 2021 and an inner annular wall 2022 connected to the outer lid top board 2021, and the connection portion 203 has an annular abutting section 2031, an enclosed end section 2032, and an outer thread section 2033 arranged between the annular abutting section 2031 and the enclosed end section 2032.

Further, a distance between the enclosed end section 2032 and the annular abutting section 2031 is less than a distance between the enclosed end section 2032 and the inner lid top board 2021 of the inner lid portion 202. Accordingly, when the straw 300 is disposed in the accommodating space 110, the upper end of the straw 300 is lower than the inner lid top board 2021 and higher than the annular abutting section 2031. In this way, when the lid 200 is disposed on the opening portion 120 of the container body 100, the straw 300 can be accommodated in the container assembly, and after the lid 200 is removed from the opening portion 120, the upper end of the straw 30 protrudes from the opening portion 120, such that the user can directly suck on the upper end of the straw 300 with the mouth.

When the lid 200 is disposed on the opening portion 120, an inner thread section 122 of the opening portion 120 and the outer thread section 2033 of the connection portion 203 are locked with each other, and the annular abutting section 2031 abuts against the upper end edge 121 of the opening portion 120. In other words, when the lid 200 is disposed on the opening portion 120, the lid 200 is sleeved around by the opening portion 120.

In the present embodiment, the container assembly is a thermobottle container assembly, and the container assembly can be used to contain hot liquid (e.g., hot water).

If the lid 200 has the inner thread section and the opening portion 120 has the outer thread section (i.e., the lid 200 is sleeved around the opening portion 120 when the lid 200 is disposed on the opening portion 120), a gap easily forms between the lid 200 and the container body 100 due to thermal expansion when the container assembly is used to contain hot liquid, and the heat insulation effect cannot be maintained. Therefore, a container assembly with the lid having the inner thread section and the opening portion having the outer thread section is not suitable to be compared to the container assembly of the present disclosure.

In addition, the outer lid portion 201, the inner lid portion 202, and the connection portion 203 of the lid 200 and the container body 100 can be made of a non-plastic material, such that when the container assembly is used to contain liquid, the liquid is not in contact with any plastic material. When the container assembly is used to contain hot liquid, no plastic material is slightly dissolved in the hot liquid. Preferably, the outer lid portion 201, the inner lid portion 202, and the connection portion 203 of the lid 200 and the container body 100 can be made of a metal material, and more preferably, the outer lid portion 201, the inner lid portion 202 and the connection portion 203 of the lid 200 and the container body 100 can be made of titanium.

The container body 100 can be a two-layered structure, and the container body 100 can have a second heat insulation space S2 in the two-layered structure.

When the lid 200 is disposed on the opening portion 120 of the container body 100, the outer thread section 2033 and the annular abutting section 2031 of the connection portion 203 and the upper end edge 121 of the opening portion 120 jointly define a third heat insulation space S3.

Further, a horizontal imaginary line H is defined between the annular abutting section 2031 and the enclosed end section 2032, and the horizontal imaginary line H passes through the first heat insulation space S1, the second heat insulation space S2, and the third heat insulation space S3. In addition, the horizontal imaginary line H also passes through the second accommodating space 230 of the lid 200.

Through the above-mentioned three heat insulation spaces (i.e., the first heat insulation space S1 in the lid 200, the second heat insulation space S2 in the container body 100, and the third heat insulation space S3 between the lid 200 and the container body 100), heat near the lid 200 does not easily escape from the container assembly, thereby providing an excellent heat insulation effect.

It should be noted that, since the lid 200 is recessed for accommodating the straw 300, if the container assembly does not have the above-mentioned three heat insulation spaces, heat near the lid 200 easily escapes from the container assembly.

Fifth Embodiment

Figure 13:
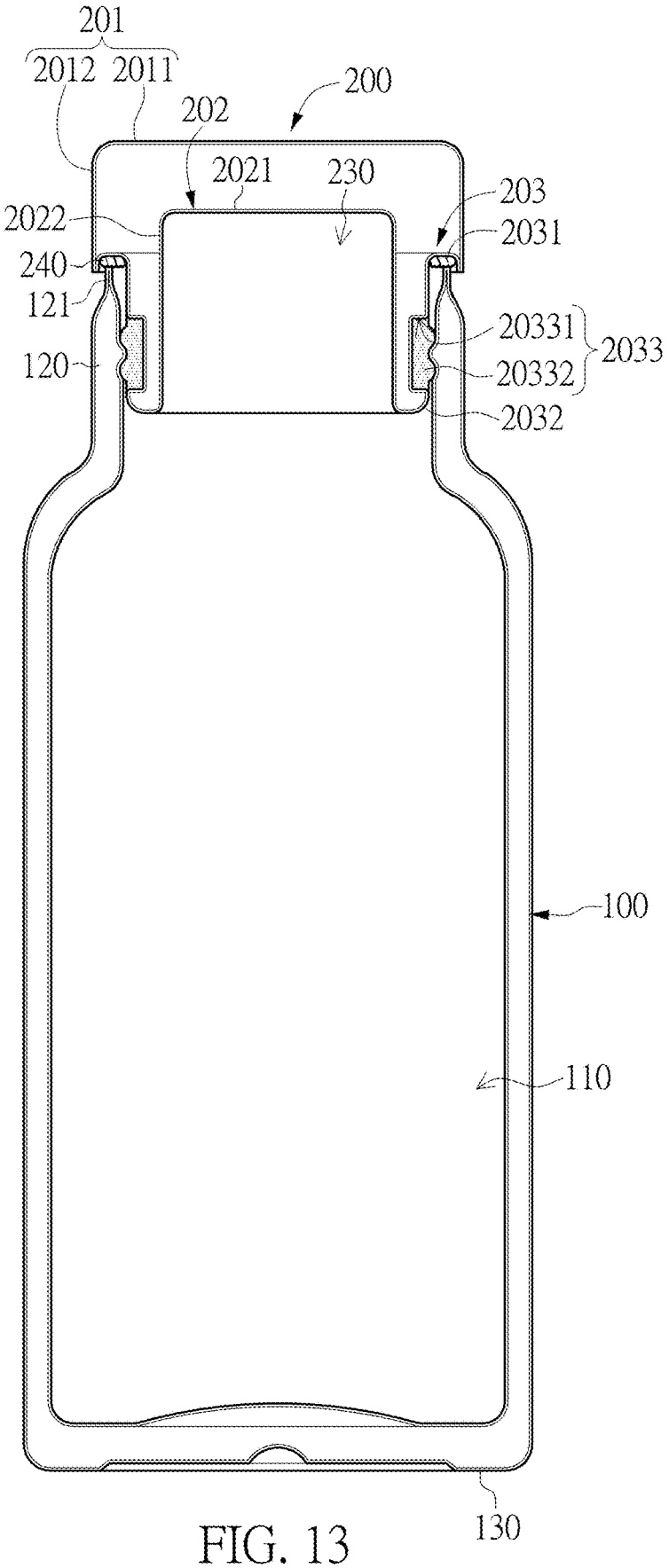
FIG. 13 is a schematic assembled cross-sectional view of a container assembly omitting a straw according to a fifth embodiment of the present disclosure.

Referring to FIG. 13, FIG. 13 shows a fifth embodiment of the present disclosure. It should be noted that the present embodiment is similar to the above-mentioned fourth embodiment, and the same parts of the fourth embodiment and the fifth embodiment will not be reiterated herein.

In the present embodiment, the outer thread section 2033 has an annular recess 20331 and a plastic thread 20332 arranged in the annular recess 20331. When the lid 200 is disposed on the opening portion 120, the outer thread section 2033 of the lid 200 is in contact with the inner thread section 122 of the opening portion 120 through the plastic thread 20332. In this way, noises generated when the lid 200 is locked onto the opening portion 120 or when the lid 200 is unlocked from the opening portion 120 can be effectively reduced.

In should be noted that, in the present embodiment, when the container assembly is used to contain liquid, the liquid is not in contact with the plastic thread 20332 and accordingly, the liquid is still not in contact with any plastic material.

Sixth Embodiment

Figure 14:
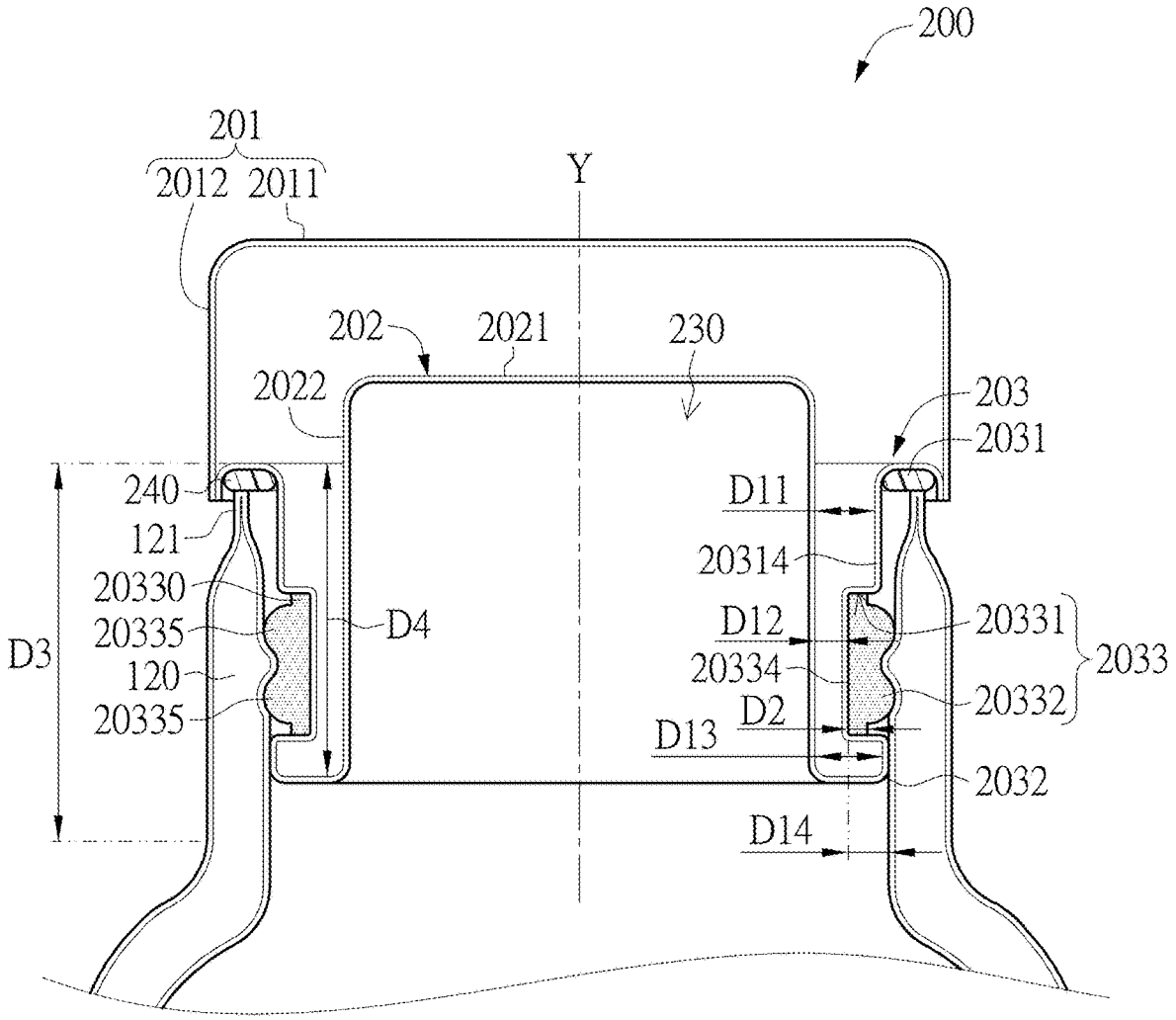
FIG. 14 is an enlarged assembled cross-sectional view of the a container assembly according to a sixth embodiment of the present disclosure.

Referring to FIG. 14, FIG. 14 shows a sixth embodiment of the present disclosure. It should be noted that the present embodiment is similar to the above-mentioned fifth embodiment, and the same parts of the fifth embodiment and the sixth embodiment will not be reiterated herein.

The annular abutting portion 2031 of the connection portion 203 has an upper wall 20314. The annular recess 20331 has a recess inner wall 20334. A upper drop height is formed between the upper wall 20314 and the recess inner wall 20334. A lower drop height D14 is formed between the enclosed end section 2032 and the recess inner wall 20334. The inner annular wall 2022 is defined with a radial direction that is along the diameter of the inner annular wall 2022. Further, the inner annular wall 2022 is defined with a central axis Y, that is parallel to the longitudinal direction of the container body 100. A first traverse distance D11 is defined between the inner annular wall 2022 and the upper wall 20314 along the radial direction of the inner annular wall 2022. A second traverse distance D12 is defined between the inner annular wall 2022 and the recess inner wall 20334 along the radial direction of the inner annular wall 2022. A third traverse distance D13 is defined in the enclosed end section 2032 along the radial direction of the inner annular wall 2022. The third traverse distance D13 is larger than the first traverse distance D11, and the first traverse distance D11 is larger than the second traverse distance D12.

In addition, the upper drop height is equal to the first traverse distance D11 minus the second traverse distance D12, and the lower drop height D14 is equal the third traverse distance D13 minus the second traverse distance D12. The lower drop height D14 is larger than the upper drop height.

The plastic thread 20332 has an annular base portion 20330 and at least one annular thread protrusion 20335 that is integrally formed on the annular base portion 20330. The annular base portion 20330 is shaped in a hollow cylinder with an even thickness. A thickness D2 of the annular base portion 20330 is smaller than the first traverse distance D11. The thickness of the annular base portion 20330 is smaller than the upper drop height.

The opening portion 120 has an upper half section and a lower half section that is connected to the upper half section. The plastic thread 20332 is contacted with the upper half section of the opening portion 120. The enclosed end section 2032 is substantially contacted with the lower half section of the opening portion 120.

The opening portion 120 and the sealing washer 240 has a first height D3 along the central axis Y of the inner annular wall 2022. A connection portion 203 has a second height D4 along the central axis Y of the inner annular wall 2022.

Beneficial Effects of the Embodiments

In conclusion, in the container assembly and the container lid provided by the present disclosure, by virtue of "the container assembly includes the container body, the lid, and the straw" and "a height of the annular pressing portion is between a height of a bottom surface of the top portion of the lid and a height of a bottom surface of the sleeved portion, and a gap is between the annular pressing portion and the bottom surface of the top portion," the inconveniences of the conventional container are modified.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A container assembly, comprising:

a container body having an accommodating space formed therein, wherein the container body defines a longitudinal direction, two ends of the container body along the longitudinal direction are respectively defined as an upper end and a bottom end, and the container body has an enclosed bottom portion at the bottom end and an opening portion at the upper end;

a lid detachably disposed on the opening portion of the container body, wherein the lid has an outer lid portion, an inner lid portion, and a connection portion that is connected to the outer lid portion and the inner lid portion, and the outer lid portion, the inner lid portion, and the connection portion jointly define a first heat insulation space, wherein the connection portion has an annular abutting section, an enclosed end section, and an outer thread section arranged between the annular abutting section and the enclosed end section, and a distance between the enclosed end section and the annular abutting section is less than a distance between the enclosed end section and an inner lid top board of the inner lid portion; and wherein the outer lid portion, the inner lid portion, and the connection portion are made of titanium metal plates;

wherein the outer thread section has an annular recess and a plastic thread arranged in the annular recess, the annular recess is surroundingly disposed on a side wall of the connection portion, the plastic thread has an annular member accommodated in the annular recess, and the plastic thread is formed on a sidewall of the annular member;

wherein, when the lid is disposed on the opening portion, an inner thread section of the opening portion and the outer thread section of the connection portion are locked with each other, and the annular abutting section abuts against an upper end edge of the opening portion;

wherein the plastic thread has an annular base portion and at least one annular thread protrusion that is integrally formed on the annular base portion, and the annular base portion is shaped in a hollow cylinder with an even thickness;

wherein the opening portion has an upper half section and a lower half section that is connected to the upper half section, the plastic thread is contacted with the upper half section of the opening portion, the enclosed end section is contacted with the lower half section of the opening portion.

2. The container assembly according to claim 1, wherein, when the lid is disposed on the opening portion of the container body, a gap between an outer lid top board of the outer lid portion and the upper end edge of the opening portion is within a range from 5 mm to 50 mm.

3. The container assembly according to claim 1, wherein the annular abutting portion of the connection portion has an upper wall, the annular recess has a recess inner wall; wherein a upper drop height is formed between the upper wall and the recess inner wall, a lower drop height is formed between the enclosed end section and the recess inner wall, wherein the inner annular wall is defined with a radial direction that is along the diameter of the inner annular wall, the inner annular wall is defined with a central axis, a first traverse distance is defined between the inner annular wall and the upper wall along the radial direction of the inner annular wall, a second traverse distance is defined between the inner annular wall and the recess inner wall along the radial direction of the inner annular wall, a third traverse distance is defined in the enclosed end section along the radial direction of the inner annular wall, wherein the third traverse distance is larger than the first traverse distance.

4. The container assembly according to claim 3, wherein the first traverse distance is larger than the second traverse distance.

5. The container assembly according to claim 3, wherein the upper drop height is equal to the first traverse distance minus the second traverse distance, and the lower drop height is equal the third traverse distance minus the second traverse distance, and the lower drop height is larger than the upper drop height.

6. The container assembly according to claim 5, wherein a thickness of the annular base portion is smaller than the upper drop height.

7. The container assembly according to claim 3, wherein a thickness of the annular base portion is smaller than the first traverse distance.

8. The container assembly according to claim 1, wherein the bottom portion of the accommodating space of the container body has a concave portion, and a lowest point of the concave portion is located at a center position of the accommodating space.

9. The container assembly according to claim 1, wherein the inner lid portion and the connection portion of the lid and the container body are made of a non-plastic material, such that when the container assembly is used to contain liquid, the liquid is not in contact with any plastic material.

10. The container assembly according to claim 1, wherein the container body is a two-layered structure, and the container body has a second heat insulation space in the two-layered structure.

11. The container assembly according to claim 10, wherein, when the lid is disposed on the opening portion of the container body, the outer thread section and the annular abutting section of the connection portion and the upper end edge of the opening portion jointly define a third heat insulation space.

12. The container assembly according to claim 11, wherein, when the lid is disposed on the opening portion of the container body, a horizontal imaginary line is defined between the annular abutting section and the enclosed end section, and the horizontal imaginary line passes through the first heat insulation space, the second heat insulation space, and the third heat insulation space.

13. A container lid, comprising:

a lid disposed on an opening portion of a container body, wherein the container body has an accommodating space formed therein, and the lid is detachably disposed on the opening portion, wherein the lid has an outer lid portion, an inner lid portion, and a connection portion that is connected to the outer lid portion and the inner lid portion, and the outer lid portion, the inner lid portion, and the connection portion jointly define a first heat insulation space, wherein the connection portion has an annular abutting section, an enclosed end section, and an outer thread section arranged between the annular abutting section and the enclosed end section, and a distance between the enclosed end section and the annular abutting section is less than a distance between the enclosed end section and an inner lid top board of the inner lid portion, and wherein the container lid is applicable for a thermobottle;

wherein the outer lid portion, the inner lid portion, and the connection portion are made of titanium metal plates;

wherein the outer thread section has an annular recess and a plastic thread arranged in the annular recess, the annular recess is surroundingly disposed on a side wall of the connection portion, the plastic thread has an annular member accommodated in the annular recess, and the plastic thread is formed on a sidewall of the annular member;

wherein the plastic thread has an annular base portion and at least one annular thread protrusion that is integrally formed on the annular base portion, and the annular base portion is shaped in a hollow cylinder with an even thickness;

wherein the opening portion has an upper half section and a lower half section that is connected to the upper half section, the plastic thread is contacted with the upper half section of the opening portion, the enclosed end section is contacted with the lower half section of the opening portion.

14. The container lid according to claim 13, wherein, when the lid is disposed on the opening portion of the container body, a gap between an outer lid top board of the outer lid portion and the upper end edge of the opening portion of the container body is within a range from 5 mm to 50 mm.

15. The container lid according to claim 13, wherein the inner lid portion and the connection portion of the lid are made of a non-plastic material, such that when the lid is used to contain liquid, the liquid is not in contact with any plastic material.

16. The container lid according to claim 13, wherein the annular abutting portion of the connection portion has an upper wall, the annular recess has a recess inner wall; wherein a upper drop height is formed between the upper wall and the recess inner wall, a lower drop height is formed between the enclosed end section and the recess inner wall, wherein the inner annular wall is defined with a radial direction that is along the diameter of the inner annular wall, the inner annular wall is defined with a central axis, a first traverse distance is defined between the inner annular wall and the upper wall along the radial direction of the inner annular wall, a second traverse distance is defined between the inner annular wall and the recess inner wall along the radial direction of the inner annular wall, a third traverse distance is defined in the enclosed end section along the radial direction of the inner annular wall, wherein the third traverse distance is larger than the first traverse distance, wherein the first traverse distance is larger than the second traverse distance.

17. The container lid according to claim 16, wherein the upper drop height is equal to the first traverse distance minus the second traverse distance, and the lower drop height is equal the third traverse distance minus the second traverse distance, and the lower drop height is larger than the upper drop height.

18. The container lid according to claim 16, wherein a thickness of the annular base portion is smaller than the upper drop height.

19. The container lid according to claim 16, wherein a thickness of the annular base portion is smaller than the first traverse distance.

* * * * *